US005380569A

United States Patent [19]

Kujas et al.

[11] Patent Number: 5,380,569

[45] Date of Patent: Jan. 10, 1995

[54] FIRE RESISTANT GLASS PARTITION

[75] Inventors: Detlef Kujas, Cologne; Günter Wiedemann, Ratingen, both of Germany

[73] Assignees: Fachverband Glasdach- und Metallbau e.V., Cologne; Promat GmbH, Ratingen, both of Germany

[21] Appl. No.: 39,209

[22] PCT Filed: Jul. 14, 1992

[86] PCT No.: PCT/EP92/01593

§ 371 Date: Apr. 8, 1993

§ 102(e) Date: Apr. 8, 1993

[87] PCT Pub. No.: WO93/02268

PCT Pub. Date: Feb. 4, 1993

[30] Foreign Application Priority Data

Jul. 19, 1991 [DE] Germany ..... 4123977

[51] Int. Cl.[6] ..... E06B 3/24; B27N 9/00

[52] U.S. Cl. ..... 428/34; 428/45; 428/122; 428/192; 428/213; 428/913; 428/921; 52/788

[58] Field of Search ..... 428/15.6, 122, 34, 99, 428/192, 913, 921, 45, 68, 213, 426; 52/788, 790; 169/54; 126/544; 220/88.1; 252/606; 49/440.1

[56] References Cited

U.S. PATENT DOCUMENTS 5,217,764 7/1993 Eich ..... 428/34

FOREIGN PATENT DOCUMENTS 2365681 4/1978 France .
2470234 5/1981 France .
2602264 2/1988 France .
8703966 7/1987 Germany .
3720121A 12/1987 Germany .

*Primary Examiner*—Donald J. Loney
*Attorney, Agent, or Firm*—Spencer, Frank & Schneider

[57] ABSTRACT

A fire resistant glass partition having at least one field formed of a multi-layer fireproof glass and equipped with fittings for fastening and/or closing elements. An end face of a pane is covered all around with an edge-gripping sealing profile of an elastic material which, at least in its region facing the end face of the pane, is provided with a material that foams under the influence of heat. The fitting components extending into the edge region are also covered by the sealing profile, with the total thickness in the enclosed region essentially corresponding to the total thickness of the pane. In this way it becomes possible for fire resistant glass partitions to also employ the panes as self-supporting structural components and to also make the joints fire resistant.

12 Claims, 7 Drawing Sheets

FIG.2
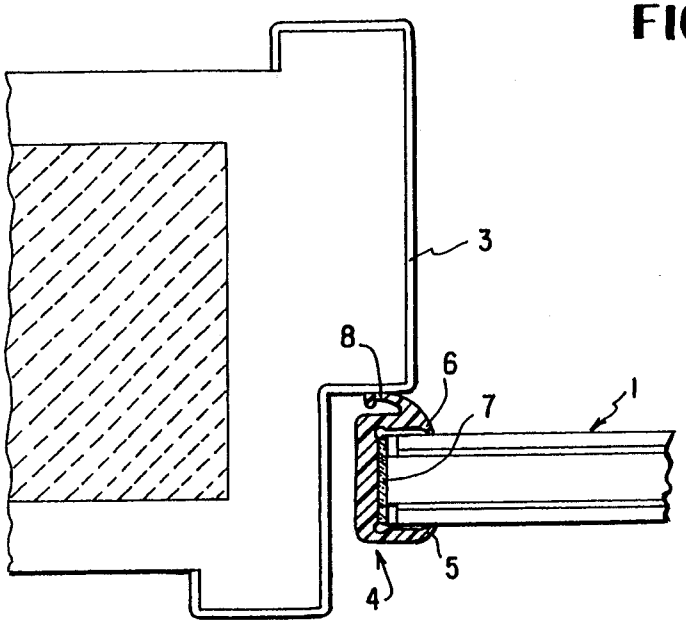
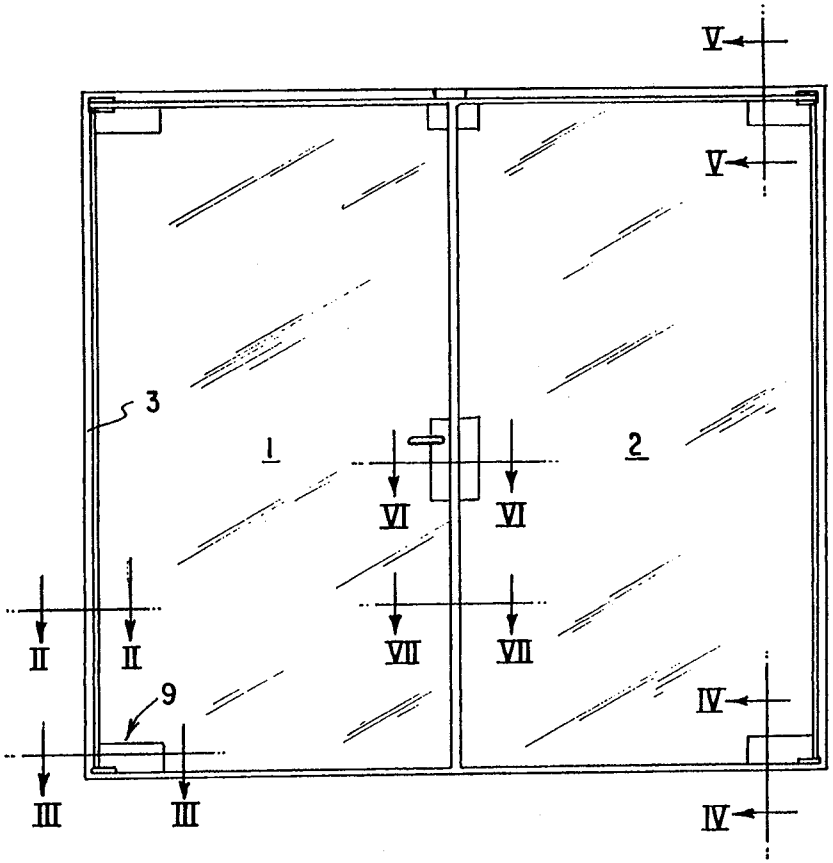
FIG. 1

FIRE RESISTANT GLASS PARTITION

BACKGROUND OF THE INVENTION

1. Field of the Invention

The invention relates to a fire resistant glass partition having at least one field formed of a pane of fireproof glass which is equipped with fittings for fastening and/or closing elements.

2. Description of the Related Art

Fire resistant glass partitions have in the past been designed in such a way that a sash was built of metal profiles into which a pane of fireproof glass was inserted and held by appropriate glass holding strips. By appropriate cover of a fire resistant material on the faces of the metal profiles facing into a room, the required fire resistance was then realized also for the region of the metal profiles. This technique was employed for stationary glass partitions, glass partitions equipped with glass doors, as well as for fire resistant glass doors alone. Accordingly, the term "glass partition" in the sense of the present invention includes a simple fire resistant door which is formed by a single field of fireproof glass as well as multi-field stationary glass partitions with and without doors. Such glass partitions have been found to be satisfactory, but do not quite meet modern architectural requirements with respect to large-area glass partitions.

Glass partitions of normal construction and employing so-called safety glass are known to be constructed in such a way that the glass panes are fixed as self-supporting components in the wall, floor and ceiling region. Adjacent glass panes are connected with one another by a thin permanently elastic silicone putty joint. Any fittings that might be required, particularly in the door region, for door strips, locks and handles, are fastened in such a way that the glass pane is provided with holes and the fittings are fixed by through-going screws and clamping plates that rest on both sides. Even if fireproof glasses are employed, a glass partition of such a design does not meet the requirements placed on it as a fire resistant partition.

SUMMARY OF THE INVENTION

It is the object of the invention to provide a fire resistant, sash-less glass partition of the above-defined type.

This is accomplished according to the invention in that the end face of the pane is covered all around with a sealing profile made of an elastic material that grips around the edges of the pane and is provided, at least in its region facing the end face of the pane, with a material that foams when heat is applied and the sealing profile also covers the fitting components that project into the edge region, with the total thickness in the enclosed region essentially corresponding to the total thickness of the pane. Such an arrangement has the advantage that the pane can be employed as a self-supporting component, with the respective joint region, be it in the region of the wall, ceiling or floor connection, be it in the region between two mutually adjacent field formed by panes, is designed in such a way that, in the case of fire, its fire resistance is ensured for the duration of the service life of the fireproof glass employed. In the case of fire, as soon as that part of the sealing profile facing the hot side is attacked or destroyed by the heat, the foaming material is exposed to the heat and is thus able to fully foam into the existing parting groove so that, for the intended period of time, neither heat nor smoke is able to pass through to the side facing away from the fire. It is significant that the fittings lying on the glass pane in the region covered by the sealing profile together with the glass pane, of which the outer layer of the fireproof glass has been partially removed, corresponds to the total thickness of the multi-layer fireproof glass pane in this region. Thus, it is possible to provide an uninterrupted continuous fire resistant seal even on doors in which, in the case of fire, the foaming material seals the joint. Another advantage of this arrangement is that the end face of the multi-layer fireproof glass is covered and is thus protected against damage, particularly against penetration of moisture or damage to the seal of the end face, as it may occur in doors. The above indicates that such a partition, particularly a multi-field partition, even if it includes a field in the form of a door, optically and thus in its architectural concept, corresponds to a sash-less partition made entirely of glass. Compared to prior art glass partitions equipped with a supporting sash structure, the sealing profiles defining the individual fields can be made very narrow so that only the outlines of the individual fields just become visible.

In a preferred embodiment of the invention, it is provided that the sealing profile has an essentially U-shaped cross section, and an outwardly oriented web-shaped projection which extends in longitudinal direction is provided at at least one leg. While the U-shaped region of the sealing profile essentially serves to protect the end face of the respective pane, receive the foaming material and fix the sealing profile itself to the pane, the continuous outwardly oriented web-shaped projection serves to provide a seal with respect to adjacent faces. This may be the region of an adjacent building wall, including floor and ceiling, but also a further adjacent stationary pane and/or an adjacent door. The shape and geometrical orientation of the web depends on the respective case of use.

In a preferred embodiment, it is provided that at least one web-shaped projection at the sealing profile is made flexible. Such a flexible projection here acts in the manner of a sealing lip so that it lies against the adjacent sealing face with a certain inherent tension. It is preferably provided that the flexible web-shaped projection begins at a free leg end of the U-shaped profile and extends in the opposite direction to the leg.

As a further feature of the invention, it is provided that an abutment web is provided at at least one leg of the U-shaped profile in the region where it is attached to the transverse web, with this abutment web projecting beyond the back of the U-shaped profile formed by the transverse web, preferably being stiffer than the web-shaped projection and continuous in the longitudinal direction. A sealing profile of such configuration can be employed to seal the joint between two stationary fields as well as to seal the joint between a stationary field and a movable field, that is, a door. The abutment web in this embodiment serves as a counter-surface for a flexible, web-shaped projection on the sealing profile of the adjacent field.

In another embodiment of the invention, it is provided that the U-shaped profile is equipped with two abutment webs which, together with the transverse web, form a U-shaped counter-profile. Such a sealing profile is preferably provided as a seal between two stationary fields. The flexible, web-shaped projections of a sealing profile equipped with two flexible web-shaped projections can then be pushed into a sealing profile. If the region of both sealing profiles gripping around the edges of the panes are provided in a corresponding symmetrical configuration, it is possible to realize a perfect optical appearance which does not indicate that the seal of the joint between the two adjacent panes is formed by two separate profiles. Another advantage of this configuration is that, as a feature of the invention, spacers and/or continuous stiffening elements can be inserted into the space between the U-shaped counter-profile, on the one hand, and the sealing profile. In this connection it is advisable to fill the remaining space between the two pushed-together sealing profiles with a material that foams under the influence of heat.

Another feature of the invention provides that the fittings are provided with clamping plates that can be screwed to the pane and over whose edges projects the clamped-in portion of the pane while the clamping plates are covered by plate-shaped covers of a fire resistant, thermally insulating material. In this way, it is ensured that the invention, by the removal of the exterior glass layers including the intermediate layers connecting the glass layers, is compensated so that the pane surfaces including the fitting regions as a whole essentially have the same fire resistance.

As a further feature of the invention, it is provided that the fire resistant, thermally insulating material is held in covering cartridges whose crimped-off edge extends to the edge of the pane and is enclosed by the sealing profile. This ensures that particularly the critical transition region is enclosed in the sealing profile and is reliably sealed.

BRIEF DESCRIPTION OF THE DRAWINGS

The invention will now be described in greater detail with reference to schematic drawings of embodiments thereof, in which:

FIG. 1 depicts a glass partition in the form of a double-wing door;

FIG. 2 is a horizontal sectional view along line II—II of FIG. 1;

DETAILED DESCRIPTION OF THE PREFERRED EMBODIMENTS

Figure 3:
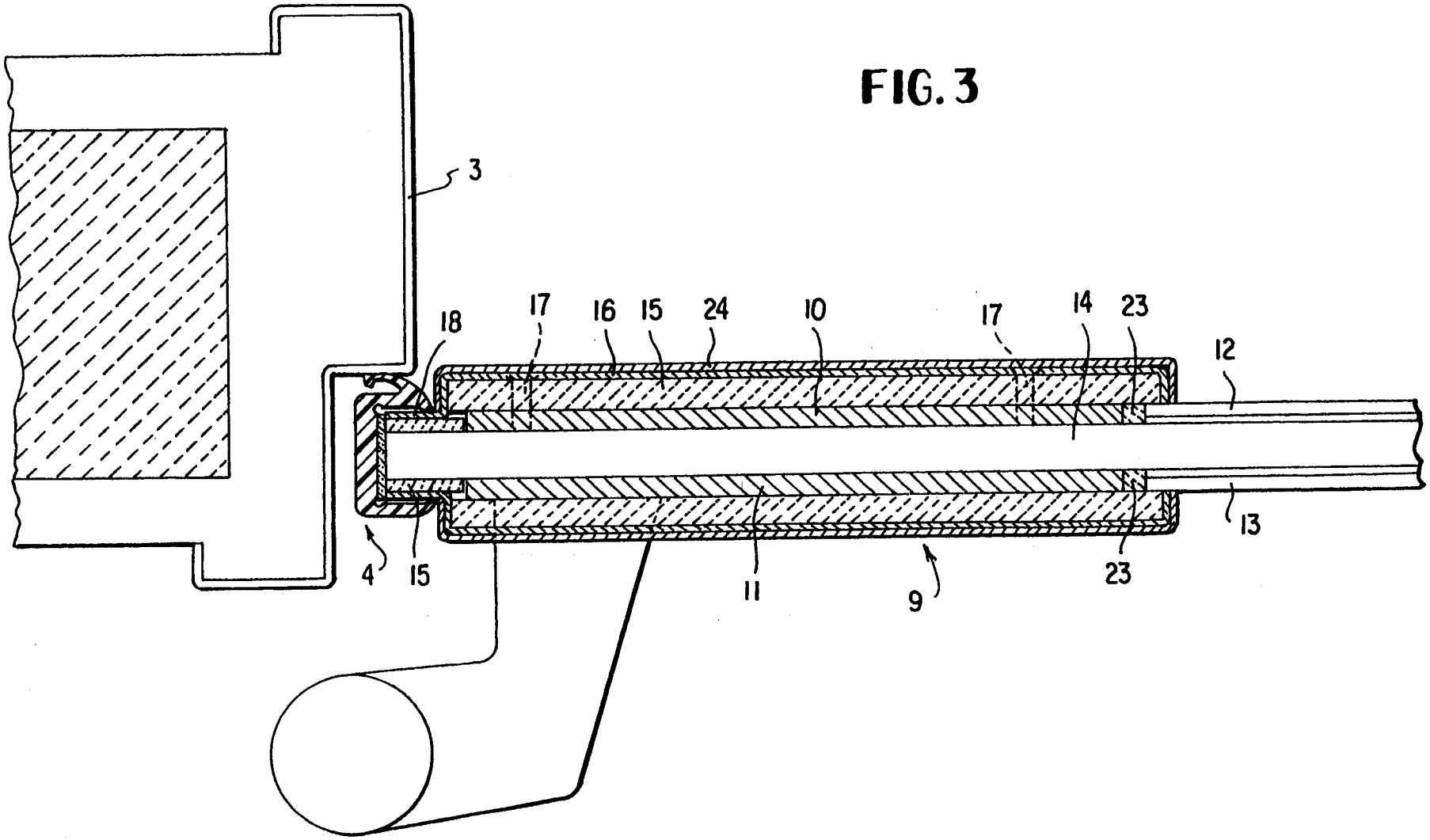
FIG. 3 is a horizontal sectional view along line III—III of FIG. 1.

FIG. 1 depicts, in a front view, a fire resistant glass partition whose two fields 1 and 2 are configured as doors. Field 1 is here the movable wing while field 2 constitutes the stationary wing. Both wings are held in the wall opening by way of a conventional frame 3.

Fields 1 and 2 are each composed of a continuous pane of a multi-layer fireproof glass and, as will be described in greater detail below, are made without sashes.

As indicated by the horizontal sectional view of FIG. 2 for the frame region of a pane made of three-layer fireproof glass, the pane is provided all around with a sealing profile 4 that grips around its edges. This sealing profile 4 has an essentially U-shaped cross section, with the two legs 5 and 6 gripping around the edge region of the pane. In the region of sealing profile 4 facing the end face of the pane, a strip 7 is inserted of a material that foams under the influence of heat. The sealing profile 4 is now pushed on and held on the pane by glue and legs 5 and 6. In the case of fire, once the portion of the profile on the side of the fire has been destroyed, the foaming material drives the remainder of the sealing profile 4 against frame 3, so that the joint between pane and frame remains tightly closed even in the case of fire. To seal against drafts, the leg 6 of sealing profile 4 is provided with a flexible, web-shaped projection 8 which begins at the free leg end of leg 6 and extends in a direction opposite to the latter.

FIG. 3 is a horizontal sectional view of the lower hinge joint 9 of field 1 which is configured as a door wing. Hinge joint 9 is here connected with the pane byway of two clamping plates 10 and 11, with the two outer glass layers 12 and 13 of the fireproof glass having been removed in the region where clamping plates 10 and 11 cover the pane so that clamping plates 10 and 11 are clamped to the thick center glass layer 14 by continuous screw bolts as in a normal all-glass door. Clamping plates 10 and 11 have such a thickness that the total thickness in this region corresponds to the total thickness of the fireproof pane.

The region of clamping plates 10 and 11 is covered on both sides by a plate 15 of a fire resistant material which, for reasons of strength and fastening, is itself held in a thin sheet metal cartridge 16. Sheet metal cartridge 16 is screwed by means of screws 17 to clamping plate 10 and clamping plate 11, respectively. The outer edge 18 of sheet metal cartridge 16 is here crimped away from the thick center glass pane 14 and is pulled forward to the outer edge together with an intermediate layer of material 15 so that this region is also covered by sealing profile 4 and thus ensures an uninterrupted, continuous seal that is resistant to fire. Hinge joint 9 at stationary wing 2 is configured in the same manner.

Figure 5:
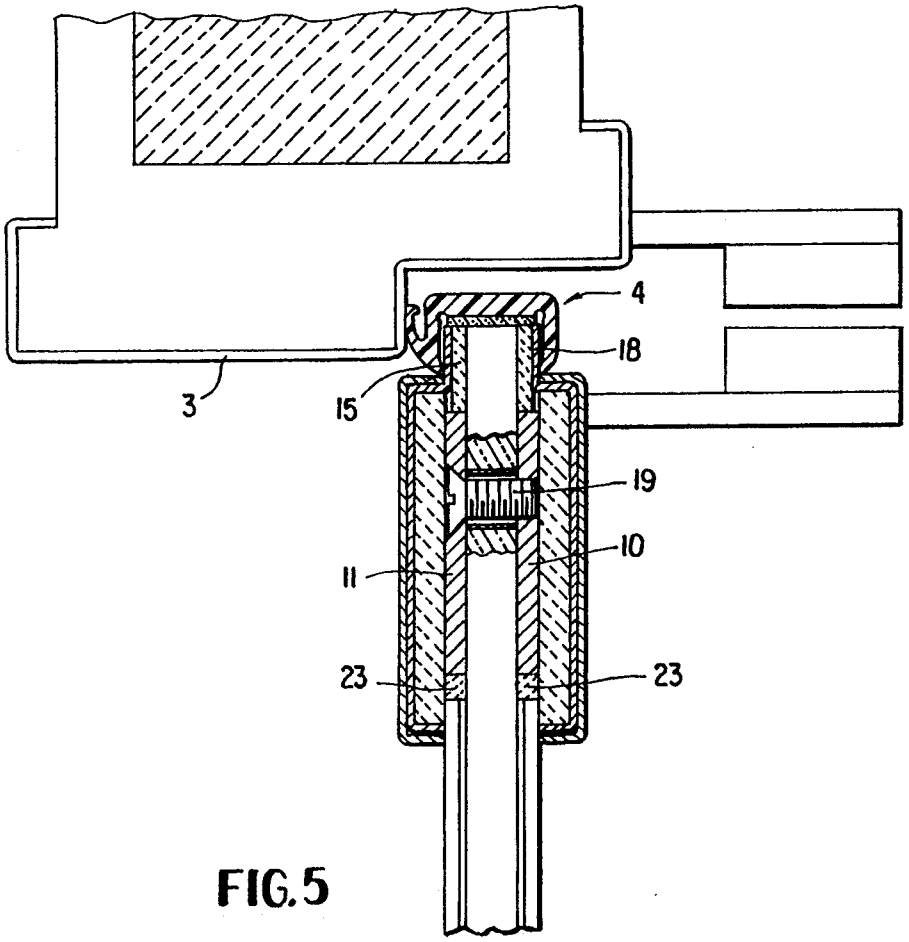
FIG. 5 is a vertical sectional view along line V—V of FIG. 1.
Figure 4:
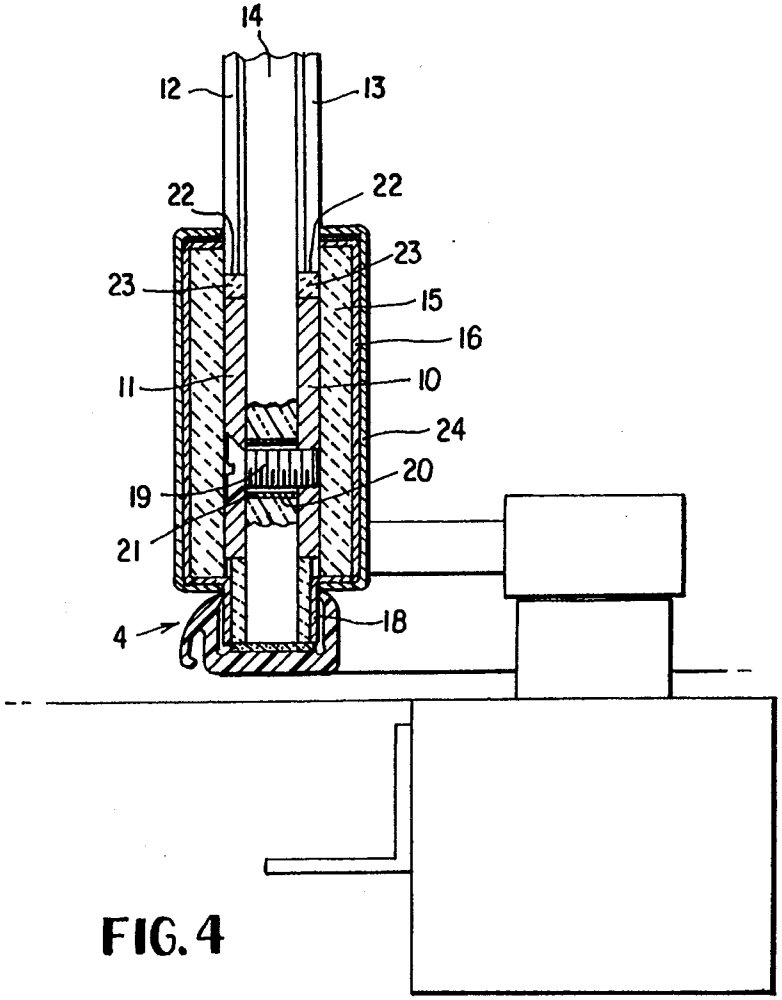
FIG. 4 is a vertical sectional view along line IV—IV of FIG. 1.

FIG. 4 is a vertical sectional view of the lower hinge joint 9. This sectional view reveals, on the one hand, the arrangement of a screw bolt 19 that connects the two clamping plates 10 and 11 together. The bore 20 through pane 14 is here advisably provided with a lining 21 which serves the purpose of preventing direct contact between the edges of the screw thread and the interior of bore 20. Between the edge 22 of the exterior glass layers 12 and 13 and the edge of the two clamping plates 10 and 11 a space is provided which is also filled with a strip 23 of a fire resistant material. This material should, if possible, have such a consistency that it simultaneously seals the sensitive intermediate layer between the center pane 14 and each of the two outer glass layers 12 and 13. For purely aesthetic reasons the sheet metal cartridge 16 in the illustrated embodiment is covered by a decorative covering 24, for example of aluminum. As shown in FIG. 5, the upper hinge joint is configured correspondingly.

Figure 6:
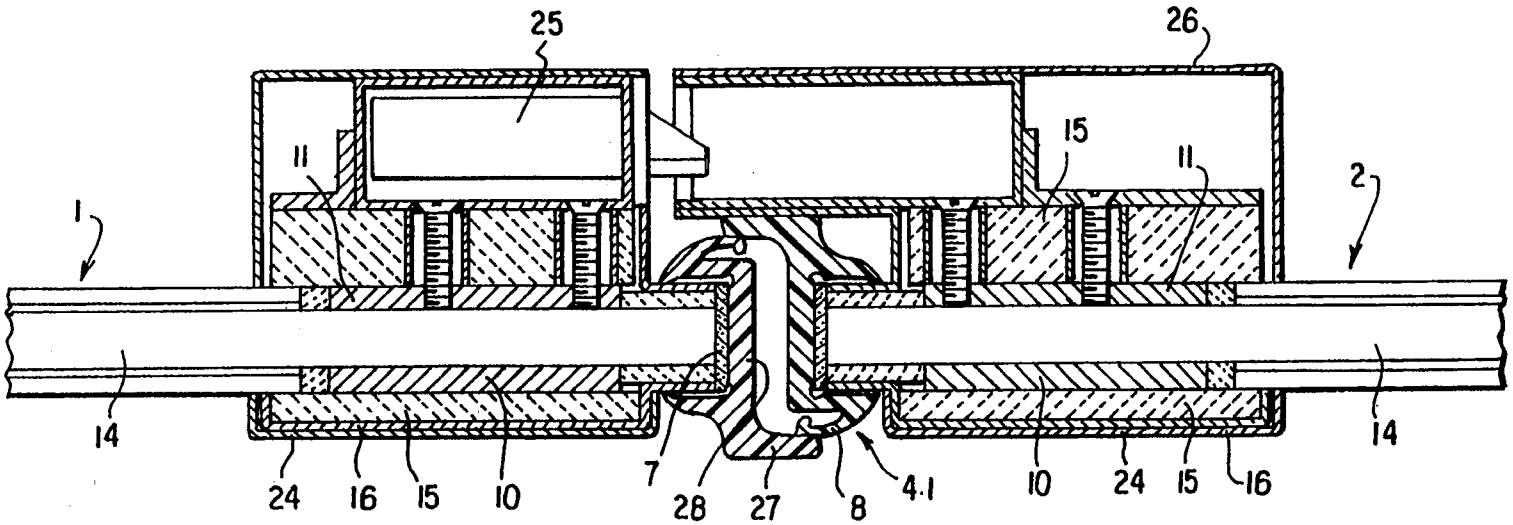
FIG. 6 is a horizontal sectional view along line VI-13 VI of FIG. 1.

FIG. 6 is a horizontal sectional view of the lock and handle region. Here again the fittings are fixed to the center pane in a similar manner to the hinge joints by appropriate clamping plates 10 and 11 and passage bolts that are not shown in detail here. Clamping plates 10 and 11 are again covered with fire resistant material 15, with lock 25 and lock box 26 constituting the cover for fire resistant material 15 in the region of the lock and lock box. On the other side, a cartridge-shaped cover 16 and a decorative cover 24 are again provided.

As can be seen in the illustration of FIG. 6, the sealing profile 4 has a somewhat different configuration in this region. The sealing profile 4.1 enclosing the edge of pane 1 or pane 2, respectively, in its vertical region, is provided, in addition to the flexible web-shaped projection 8 described in connection with FIG. 2, with an additional abutment web 27 that follows the transverse web 28 constituting the back of sealing profile 4.1 and projects beyond it toward the other side. Due to having a correspondingly greater material thickness, abutment web 27 is stiffer than web-shaped projection 8 so that, in the illustrated closed position, the web-shaped projection 8 of the one sealing profile 4.1 lies against the interior face of the stiffer abutment web 28 of the other sealing profile 4.1 and is deformed as indicated in the illustrated closed position. Otherwise, the configuration, arrangement and manner of fastening corresponds to that described in connection with FIG. 4.

Figure 7:
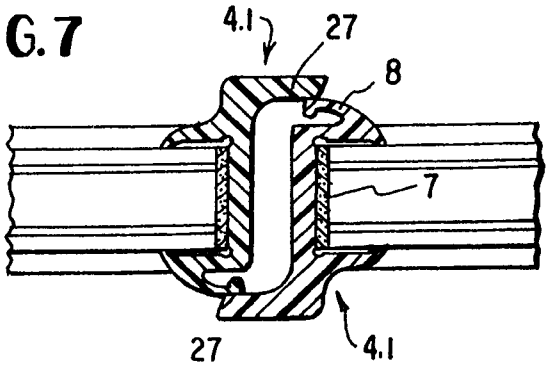
FIG. 7 is a sectional view along line VII—VII of FIG. 1.

The horizontal sectional view of FIG. 7 reveals that the two sealing profiles 4.1 cover the door gap between movable wing 1 and stationary wing 2 without interruption from the floor to the ceiling. Here again, the material 7, which foams under the influence of heat and is disposed within the U-shaped region of the two profiles 4.1, closes the gap in the case of fire.

Figure 8:
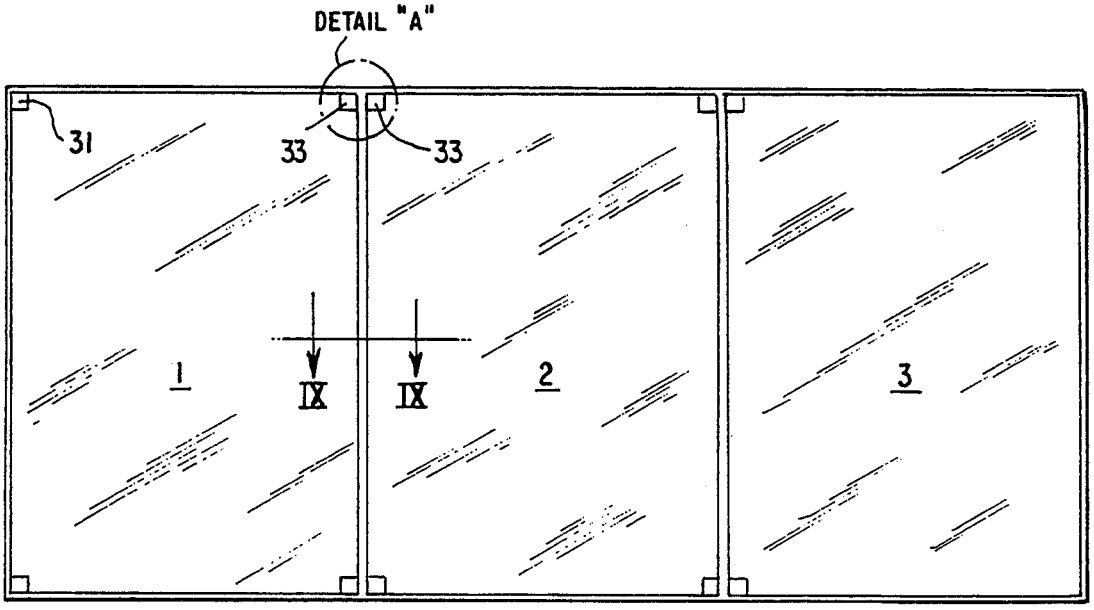
FIG. 8 depicts a stationary glass partition.

FIG. 8 shows for further clarification a stationary, fire resistant, sash-less all-glass partition. In the illustrated embodiment, fields 1, 2 and 3 are again constructed one-story high of panes made of fireproof glass of the above-described type. The vertical joints between the individual fields 1, 2 and 3 are now sealed by way of sealing profiles 4.1 as described already in connection with FIG. 7 for the embodiment according to FIG. 1 or in the manner shown in FIG. 9. Sealing profiles 4.2 and 4.3 in the form shown in FIG. 9 constitute modifications of the sealing profiles 4.1 described in connection with FIG. 7. Sealing profile 4.2 is here shaped in such a way that it has two abutment webs 27 and thus forms a U-shaped counter-profile for profile 4.3 which in turn has a symmetrical configuration and is provided with two flexible web-shaped projections 8. Thus, the arrangement according to FIG. 9 has a centering effect compared to the embodiment of FIG. 7.

Figure 9:
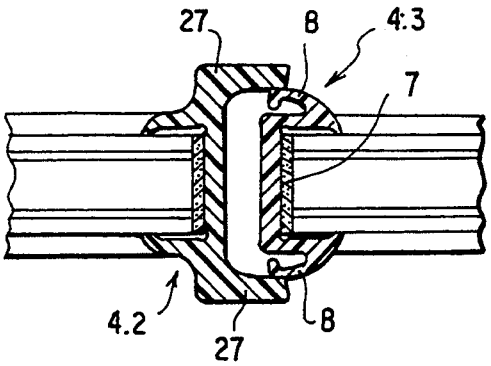
FIG. 9 is a cross-sectional view along line IX—IX of FIG. 8.
Figure 10:
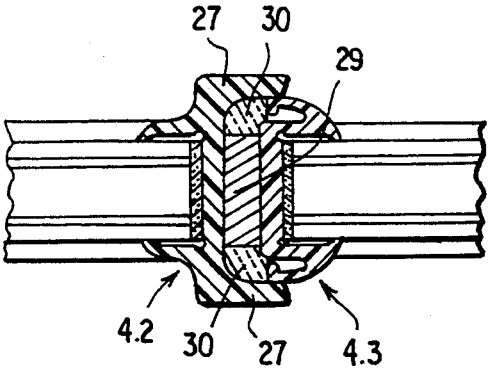
FIG. 10 depicts another embodiment of the arrangement according to FIG. 9.

Another advantage of the embodiment according to FIG. 9 can be seen in the modification thereof shown in FIG. 10. In this embodiment, a reinforcement 29, for example a metal rail, can be inserted into the space defined by profile 4.2 and profile 4.3. Reinforcement 29 is then covered on both sides by a strip 30 of a thermally insulating, fire resistant material which may also be a material that foams under the influence of heat. The shape of sealing profile 4.2 shown in FIG. 10 can also be inserted as a connecting profile in the wall, floor or ceiling region. Particularly in the floor region, the pane is then "blocked in" instead of the continuous reinforcement shown in FIG. 10, so that the weight of the pane is absorbed on the floor by way of the inserted blocks. Here again strips of the material that foams under the influence of heat are inserted into the remaining cavities of the U-shaped counter-profile so that, in the case of fire, the joint is sealed automatically. Profile shape 4.2 is not limited to the illustrated embodiment. Abutment webs 27 may be given thinner walls particularly for such wall connection profiles, advisably with their outer contours, otherwise remaining the same so that webs 27 act in the manner of sealing lips.

Figure 11:
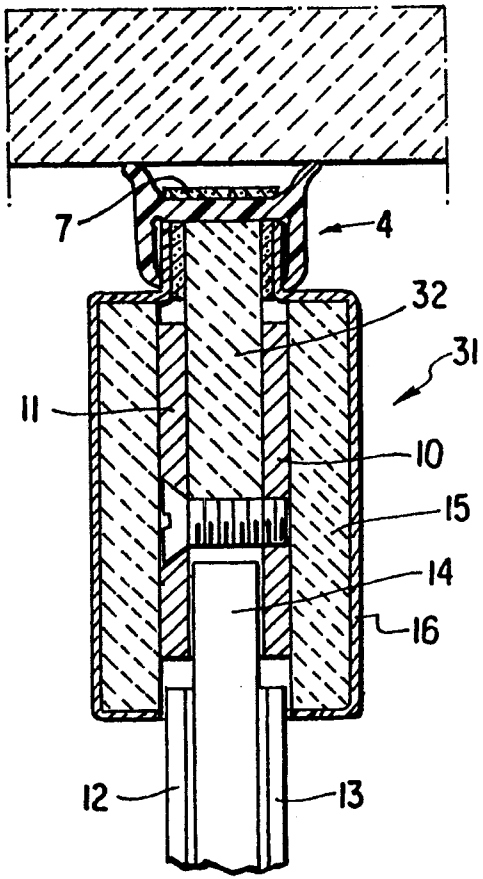
FIG. 11 is a vertical sectional view along line XI—XI of FIG. 13.

As shown in the vertical sectional view of FIG. 11 for the ceiling region, the stationary fields of a glass partition can be screwed to the ceiling by a fitting element provided in the floor and ceiling regions. Here again, fire resistance is attained with the aid of clamping plates 10 and 11, which are covered in cartridges 16 by way of fire resistant material 15. This fastening fitting 31 differs from the other fittings, particularly in that here the thick center glass pane 14 is also given a recess in its edge so that only a part of glass pane 14 is enclosed by clamping plates 10 and 11. The part of the recess along the edge is also replaced by a block 32 of fire resistant material which is brought into the edge region and is enclosed by the sealing profile in the prescribed manner. With the aid of the block, the entire arrangement is screwed to the ceiling or the floor so that the transverse forces are reliably absorbed there.

Figure 12:
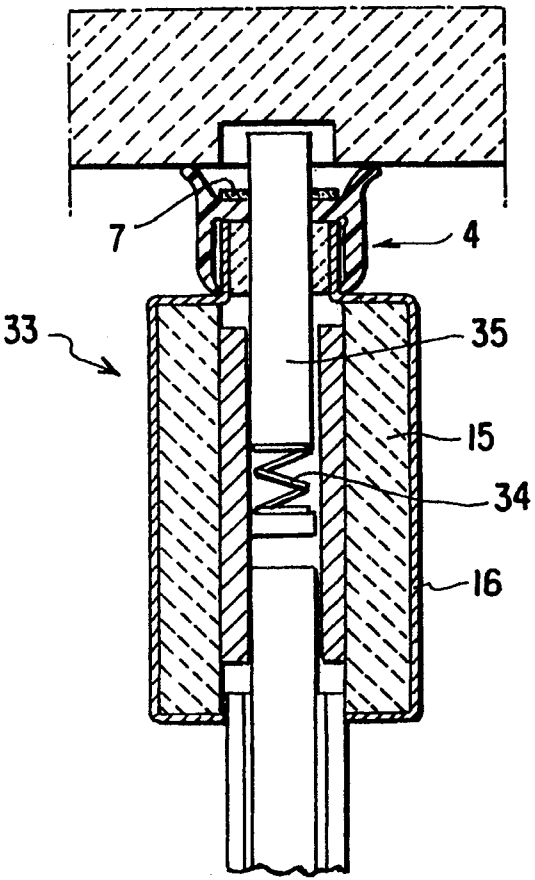
FIG. 12 is a vertical sectional view along line XII—XII of FIG. 13.
Figure 13:
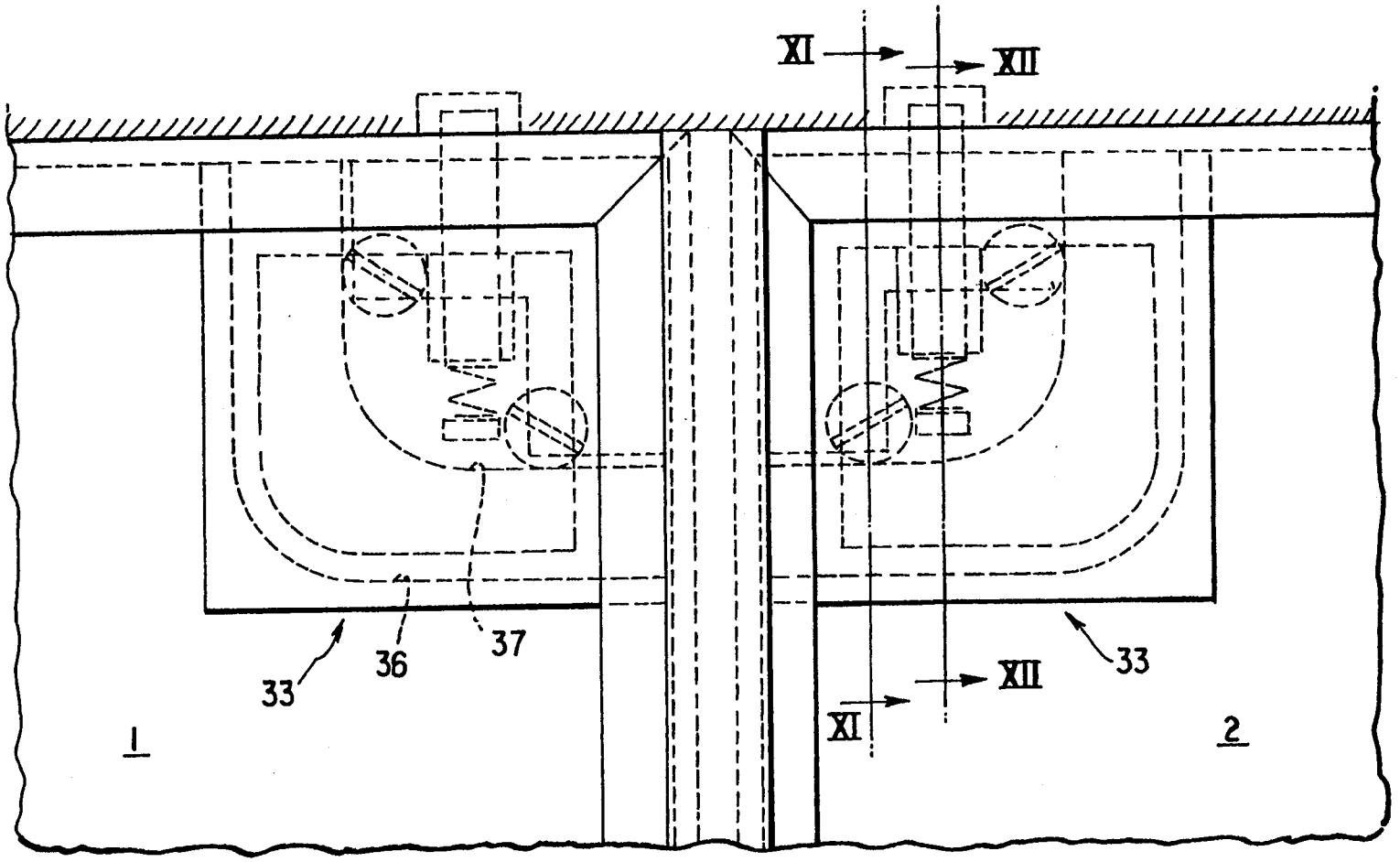
FIG. 13 depicts the detail A of FIG. 8 to an enlarged scale.

FIGS. 12 and 13 depict, in a cross-sectional view and in a top view, a fastening element 33 as an enlarged representation of the detail A of FIG. 8. Fastening element 33 approximately corresponds in its configuration to fastening element 31 so that the sectional view of FIG. 11 corresponds to the sectional view XI—XI of FIG. 13. Instead of a fastening screw in a passage bore, a snap pin 35 supported by a compression spring 34 is guided in a bore in block 32 to snap into a corresponding bore in the wall of the building as this is evident from FIG. 13 in conjunction with FIG. 12.

As shown in FIG. 13, the two covering panes 12 and 13 are cut out in their corner regions to correspond to edge contour 36. The thick center glass pane 14 is cut out to correspond to contour 37 so that clamping plates 10 and 11 can be clamped directly onto this pane.

We claim:

1. A fire resistant glass partition comprising:

at least one pane of a multi-layer fireproof glass having a fitting element, the pane having edges with an end face at each edge, the fitting element projecting to an edge of the pane; and a sealing profile covering all end faces of the pane, the sealing profile being formed from an elastic material for gripping the edges, the sealing profile having a region facing each end face of the pane, the region having a material that foams under the influence of heat, the fitting element being enclosed by the sealing profile with a total thickness of the sealing profile and the enclosed fitting element being essentially a total thickness of the pane.

2. A fire resistant glass partition according to claim 1, wherein the fitting element is a fastening element for fastening the pane to a supporting structure.

3. A fire resistant glass partition according to claim 1, wherein the fitting element is a closing element.

4. A fire resistant glass partition according to claim 1, wherein the sealing profile has a U-shaped cross section with two legs forming sides of the U-shaped cross section and a base forming a bottom of the U-shaped cross section, and a web-shaped projection oriented outwardly from at least one leg and being continuous along the at least one leg in a longitudinal direction along the sealing profile.

5. A fire resistant glass partition according to claim 4, wherein the web-shaped projection is made from a flexible material.

6. A fire resistant glass partition according to claim 4, wherein the web-shaped projection has a first edge at an end of the at least one leg which is opposite the base of the U-shaped profile and which extends in a direction opposite the leg.

7. A fire resistant glass partition according to claim 1, wherein the sealing profile has a U-shaped cross section with two legs forming sides of the U-shaped cross section and a base forming a bottom of the U-shaped cross section, and a first abutment web formed at the base of the sealing profile projecting outwardly continuously in a longitudinal direction along the sealing profile and in a direction away from an opening of the U-shaped cross section of the sealing profile.

8. A fire resistant glass partition according to claim 7, wherein the sealing profile is provided with a second abutment web which, together with the first abutment web, forms a U-shaped counter-profile.

9. A fire resistant glass partition according to claim 8, wherein the U-shaped counter-profile formed by the first and second abutment webs encloses a stiffening element formed along the longitudinal direction of the sealing profile.

10. A fire resistant glass partition according to claim 9, wherein the stiffening element has a first edge and a second edge formed along the longitudinal direction of the sealing profile, the first and second edges of the stiffening element being within the counter-profile, and at least one of the first and second edges of the stiffening element is covered with a thermally insulating material that foams under the influence of heat.

11. A fire resistant glass partition according to claim 1, wherein the fitting element includes a clamping plate fastened to the pane, the clamping plate being covered by a fire resistant material.

12. A fire resistant glass partition according to claim 11, wherein the fire resistant material is held by a covering cartridge having a crimped-off edge extending to the edge of the pane and is covered by the sealing profile.

* * * * *